US005331826A

United States Patent [19]

Stockhaus et al.

[11] Patent Number: 5,331,826

[45] Date of Patent: Jul. 26, 1994

[54] ICE RINK MAKING EQUIPMENT AND PROCESS FOR RESURFACING ICE

[75] Inventors: Patrick J. Stockhaus, Columbia Heights; Jeffrey D. McCallum, Buffalo, both of Minn.

[73] Assignee: Icecycle Corporation, Plymouth, Minn.

[21] Appl. No.: 956,661

[22] Filed: Oct. 2, 1992

[51] Int. Cl.[5] ..... A63C 19/10; F25C 1/00

[52] U.S. Cl. ..... 62/235; 62/74; 62/260

[58] Field of Search ..... 62/66, 74, 235, 259.1, 62/260, 340, 347, 59

[56] References Cited

U.S. PATENT DOCUMENTS

| | | | |
|---|---|---|---|
| 218,024 | 7/1879 | Hennessy et al. . | |
| 305,551 | 9/1884 | Vieweger | 62/235 |
| 2,010,831 | 8/1935 | Strite | 62/235 |
| 2,628,364 | 2/1953 | Wallace et al. . | |
| 2,676,471 | 4/1954 | Pierce, Jr. | 62/74 |
| 3,257,815 | 6/1966 | Brocoff et al. | 62/74 X |
| 3,425,630 | 2/1969 | Fessler . | |
| 3,464,625 | 9/1969 | Carlsson | 62/74 X |
| 3,495,415 | 2/1970 | MacCracken | 62/74 |
| 3,882,943 | 5/1975 | Cude et al. . | |
| 4,345,439 | 8/1982 | Gundlach | 62/74 X |
| 4,428,532 | 1/1984 | Holden-Parker . | |
| 4,467,619 | 8/1984 | Kovach . | |
| 4,523,879 | 6/1985 | Finucane et al. | 62/260 X |
| 4,551,985 | 11/1985 | Kovach | 62/260 X |
| 4,567,731 | 2/1986 | Horan | 62/59 |
| 4,699,545 | 10/1987 | Chen et al. | 62/260 X |

FOREIGN PATENT DOCUMENTS

| | | | |
|---|---|---|---|
| 0101359 | 4/1990 | Japan | 62/74 |
| 1388674 | 4/1988 | U.S.S.R. | 62/74 |

*Primary Examiner*—Henry A. Bennet
*Assistant Examiner*—Christopher B. Kilner
*Attorney, Agent, or Firm*—Merchant, Gould, Smith, Edell, Welter & Schmidt

[57] ABSTRACT

An ice forming apparatus to form an ice surface in an ice rink, comprising a water supply conduit located adjacent to the ice rink and connected to a supply of water. A plurality of sprinkler conduits are connected to the water supply conduit. Attached to each sprinkler conduit is a single sprinkler head. Between each sprinkler head and the water supply conduit is a valve operably attached to the sprinkler conduit. One or more valves may be opened so that water sprinkles onto the rink to form a smooth layer of ice.

3 Claims, 6 Drawing Sheets

ICE RINK MAKING EQUIPMENT AND PROCESS FOR RESURFACING ICE

TECHNICAL FIELD

This invention relates generally to forming ice on a rink surface of an ice skating rink, and more particularly to an automated system that improves the quality of the ice skating surface formed on the rink surface while saving substantial energy costs, and shortening the time necessary to complete the task.

BACKGROUND OF THE INVENTION

Rink surfaces vary in type, but are generally made out of sand or concrete. Located immediately below the rink surface is a series of chiller tubes. When the chiller tubes are activated the rink surface drops below 32° Fahrenheit. If there is water on the rink surface when the chiller is activated, it as expected freezes. Chillers are necessary for ice rinks located in areas whose surrounding air temperatures are greater than 32° Fahrenheit. If the air temperature surrounding a rink surface is consistently below 32° F. the chillers would not be necessary.

The process of forming ice on a rink surface that is disclosed in the prior art is a very labor intensive task, generally taking approximately 100 laborer hours to perform. More specifically this process utilizes a fire hose to deliver water to the rink surface. One or more workers hold the fire hose and walk about the rink surface spreading the water while the chiller is activated. Sometimes, if the water does not evenly spread on the rink surface, a shovel or squeegee must be used to spread the water evenly. Once the rink surface is covered, the workers leave the rink surface and allow the water to freeze. After this initial application the fire hose is once again dragged about the rink surface to apply another layer of water. A squeegee and or shovel is again used to assist in the even application of the water so it does not freeze unevenly. This process is continued until a sufficiently thick layer of ice is formed on the rink surface for ice skating. The ice will normally remain in place until the chiller is turned off so this process is generally done only once a season.

The above described method causes economic problems for both ice rink operators and skaters alike. The first of which is that it is very costly to perform. A compressor is used to cool the chiller tubes and if a greater amount of water is on the surface of the rink the compressor uses more energy. When using a fire hose, the amount of water on the rink surface is enough to load the compressor to a high degree. This higher cost contributes to smaller profits for owners of ice rinks, and higher rates charged to those who wish to skate. Further the process can take up to over a week to perform, which forces ice rink owners to have less skating time available for their patrons.

The method of the prior art also has severe practical problems. The first of which is unique to sand surfaced rinks. The sand surface is often not too hard, and when the workers walk over it dragging the fire hose behind them, they leave foot prints, generally disturbing what was once an even surface. This can only be resolved by smoothing out the sand, either with shovels or some other means, which further contributes to the difficulty of the task. Once the first layer of ice is formed on a sand rink surface, or on a concrete rink surface, the two surfaces are nearly identical for purposes of further water applications. Applying the next layer of water causes problems as well. When the second layer of water is applied to the rink surface, the first layer of ice may be somewhat soft. The primary cause of this is that when the next layer of water is applied, it melts some of the underlying ice. When the workers walk over this soft ice with the fire hose, the ice may crack or form ridges, which decreases the quality of the final skating surface. This problem may be encountered every time another layer of water is applied to form the next layer of ice, which is quite frequent in this process.

Another practical problem has to do with the use of fire hoses to apply the water. Fire hoses are typically used because of their high rate of water delivery. If it were not for these high rates of water delivery the amount of time required to perform the task of forming ice on a rink surface would be substantially greater. Fire hoses are designed to sweat, or emit water, so they will not burn in a fire. This causes a very serious problem when using one to make ice. If the fire hose is left in a single position for too long when the chiller tubes are activated, the sweat from the fire hose will cause the fire hose to freeze to the existing ice surface. If the fire hose freezes to the ice surface it can be removed by either pulling it off, which may crack the ice, leave a crater in the ice, or damage the hose, or the ice could be partially melted to remove the hose, all of which are unwelcome options.

The present invention solves these and other problems with the prior art by providing an automated system, that does not require people to walk about the ice surface, while providing an even application of water to the ice. The invention further provides spray zones, which allow the system to work continuously until the ice is finished. The continuous operation allows the compressor driving the chiller tubes to operate at a steady state, as compared with the prior method which requires surges of energy every time a new layer of water is added. The benefits of the invention include that using the inventive device is substantially cheaper over time, can finish the process of forming the ice in a much shorter time, while providing an improved skating surface.

These and other advantages of the invention over the prior methods of forming ice on a rink surface will become more apparent after reading the description and the claims that follow.

SUMMARY OF THE INVENTION

The invention is an ice forming system used to form ice in a skating rink. The system comprises a water supply conduit located adjacent to the ice rink and connected to a supply of water. A plurality of sprinkler conduits are connected to the water supply conduit. Attached to each sprinkler conduit is a single sprinkler head. Between each sprinkler head and the water supply conduit is a valve operably attached to the sprinkler conduit. One or more valves may be opened so that the water sprinkles onto the rink to form a smooth layer of ice.

A second embodiment of the invention further provides for a multi-position valve, having a water input, an air input and a water output. The valve can be positioned as to allow either water or air into the system. When air is allowed into the system, any excess water in the system is removed.

DETAILED DESCRIPTION OF THE INVENTION

Throughout the following description reference will be made to the drawings and the same numerals will be used throughout the different views, to indicate the same or like parts of the invention.

PREFERRED EMBODIMENT

Figure 1:
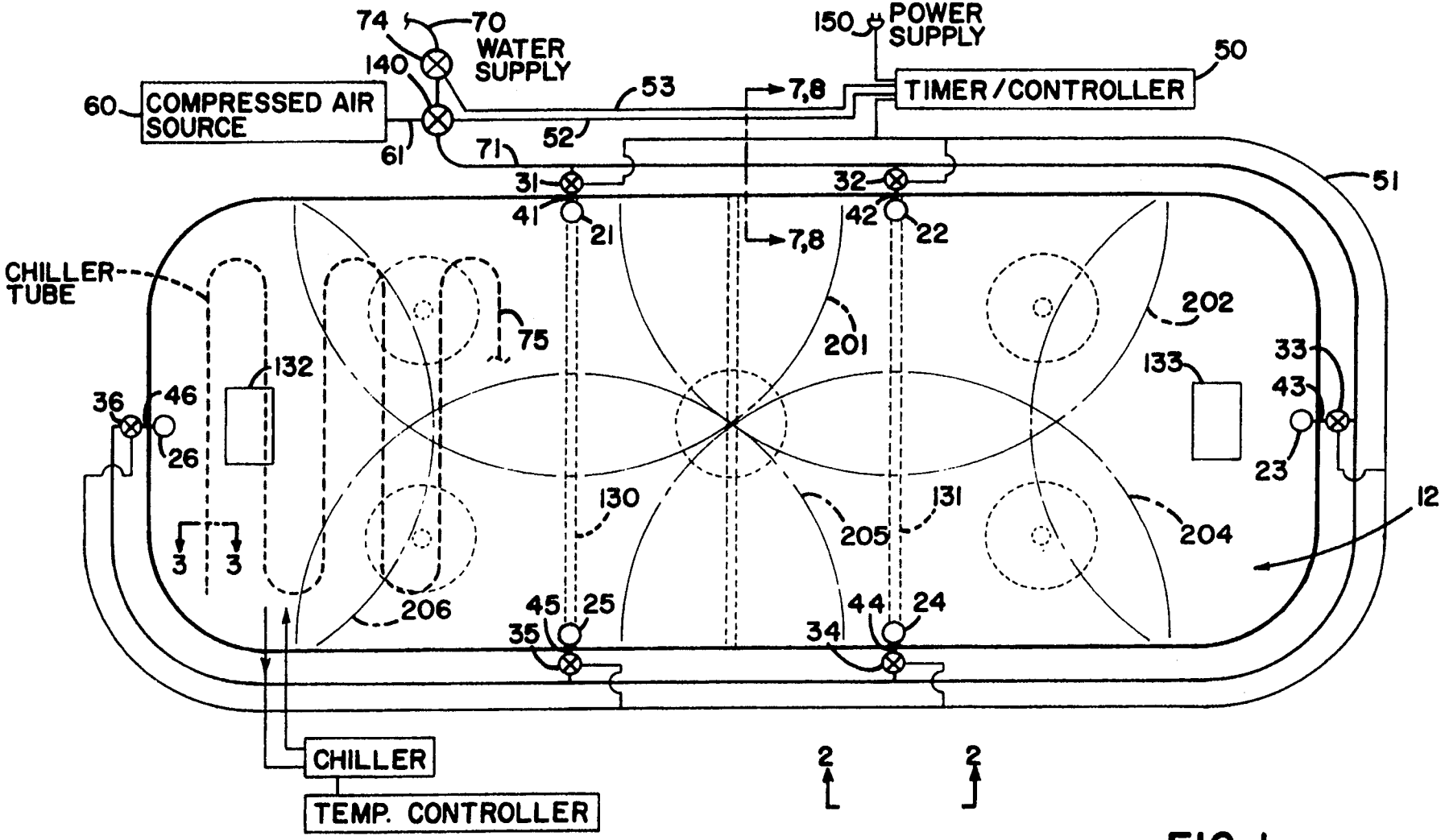
FIG. 1. is a schematic plan view of an ice rink, showing the invention with the preferred spray design.
Figure 2:
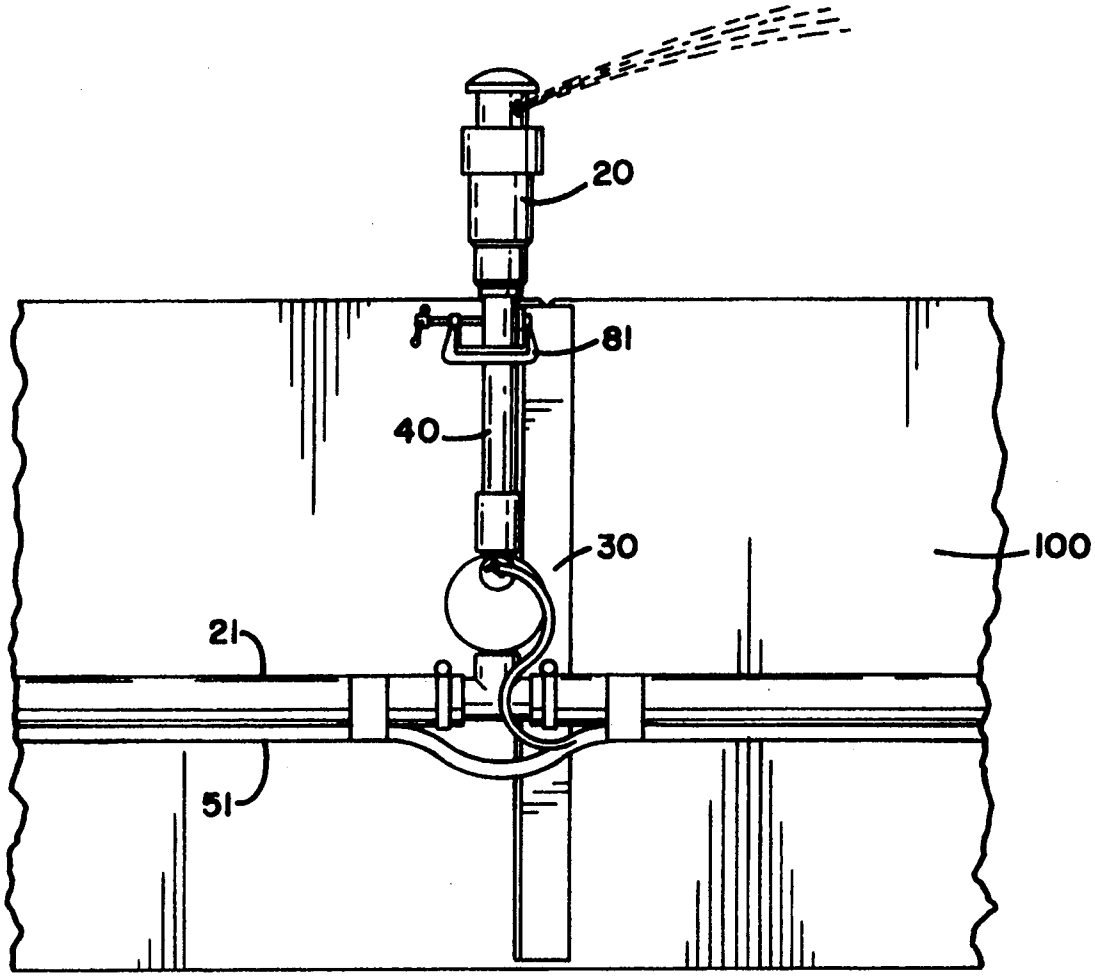
FIG. 2. is a partial elevational view taken generally along line 2—2 in FIG. 1 of the water dispenser.

Referring generally to FIGS. 1 and 2, this invention is an apparatus that makes forming ice in an ice skating rink substantially easier than in the past. The ice forming apparatus includes a water supply conduit, 71, that follows along the perimeter of the ice rink. Attached to the water supply conduit, 71, are sprinkler conduits, generally 40, each of which has a sprinkler head, generally 20, attached to it. In the preferred embodiment there are six such sprinkler heads. The operation of each sprinkler head, 20, is controlled by an electro-mechanical valve, generally 30, located on the sprinkler conduit, 40, between the sprinkler head, 20, and the water supply conduit, 71. The electro-mechanical valve, 30, is connected to a timer/controller, 50, that signals each individual valve, 31–36, when to open, or close. Each sprinkler, 20, sprinkles water onto the rink surface for a predetermined amount of time, and then stops, allowing the water time to freeze. While this water is freezing, another sprinkler sprinkles water onto the rink surface, for continuous operation.

If the apparatus is to be used in a below freezing environment, a second embodiment clears the excess water out of a dormant sprinkler head, 20, and sprinkler valve, 30, so it does not freeze. This is accomplished by providing an electro-mechanical multi-position valve, 140, that is attached to the timer/controller, 50, that moves the multi-position valve from a position that allows water into the system to a position that allows compressed air into the system. The compressed air blows the excess water out of the system through any open sprinkler valves, and sprinkler heads. Once the excess water is blown out the open sprinkler valves can be closed, and the multi-position valve, 140, can be returned to the position allowing water into the system so that more ice can be made.

In the preferred embodiment the water supply conduit, 71, is held in place on the boards, 100, which surrounds the rink, 12, by brackets 81. The water supply conduit, 71, is connected to the water supply, 70, through a water supply valve, 74. The water supply valve is a conventional open/close valve that can be actuated either manually or electrically. In the preferred embodiment the water supply valve, 74, is electro-mechanical and controlled by the timer/controller, 50, through cable, 53. The water supply conduit, 71, is generally constructed of Boston Polyforce II, and generally has an inner diameter between the ranges of $\frac{5}{8}$ and 1 inch. A diameter in this range typically provides adequate water volume to deliver 14 gallons per minute at water pressures between 40 and 80 psi. The diameter of the water supply may change depending on the local conditions so that appropriate pressure and volume ranges are delivered for the pressure available.

Attached to the water supply conduit, 71, are six sprinkler conduits, generally 40 as shown in FIG. 2, located at preselected positions along the water supply conduit, 71. In the preferred embodiment these locations are as follows. One sprinkler conduit generally behind the west goal, 132, one generally behind the East goal, 133, one generally at each end of the East "blue line" 131, and one generally at each end of the West "blue line", 130. The sprinkler conduits, 40, generally are constructed of the same material, and share the same diameter as the water supply conduit, 71. The configuration of the sprinkler conduit, 40, is a function of the placement of the water supply conduit, 71. In the preferred embodiment the water supply conduit, 71, is held in place by brackets, 81, along the boards, 100. The sprinkler conduit, 40, shown in FIG. 2, is generally straight. Because the boards and glass that surround the skating rink vary from skating rink to skating rink no single embodiment of the sprinkler conduit is optimal for all skating rinks.

Attached to the opposite end of the sprinkler conduit, 40, is a sprinkler head, generally 20, as seen in FIG. 2. More specifically, in the preferred embodiment the sprinkler head, 20, is of the pop-up type, and can be purchased commercially under the trademarks Rainbird, Toro, Hunter, or others. An example of a suitable head would be the Hunter model number I40. Generally the sprinkler head, 20, should spray water at a diameter of approximately 50 feet, or 60% of the width of the rink, at a rate of 14 gallons per minute. It should be clear that different ice rinks have different dimensions, and that by adjusting the water pressure, or changing the type, number or location of the sprinkler heads, different ice rinks may be accommodated by using the present invention.

As shown in FIG. 2, there is an electro-mechanical, or solenoid valve, generally 30, located on the sprinkler conduit, 40, between the sprinkler head, 20, and the water supply conduit, 71. It should be noted that this valve need not be electro-mechanical and generically it is known as a sprinkler valve. The sprinkler valve, 30, has an open and a closed position and is moved to its opened or closed position by the timer/controller, 50. Timer/Controller, 50 is connected to sprinkler valves, 31 through 36, by a cable, 51. Generally the solenoid valve, 30, is of the type used in lawn sprinkler systems, and can be purchased under the trademarks, Rainbird, or Toro. For example if the Hunter I-40 model sprinkler head is used, the Rainbird model CP075 solenoid valve would accompany it. Although different combinations from different manufactures would be possible.

The timer/controller, 50, controls the operation of the system. Generally the timer/controller, 50, is connected to a power source, and connected to each sprinkler valve, 31 through 36, by cable, 51, as seen in FIG. 1. The timer/controller, 50, is a multi-station, multi-function, low voltage timer. These timers are commonly used in lawn sprinkler systems. An example of a timer/controller would be the Rainbird model ESP6I six station timer. The cables, that run from the timer/-controller, 50, are generally constructed of copper or aluminum and have a light gauge diameter suitable for low voltage operation. Cable 51 may be placed proximate to the water supply conduit, 71, as shown in FIG. 2.

Figure 10:
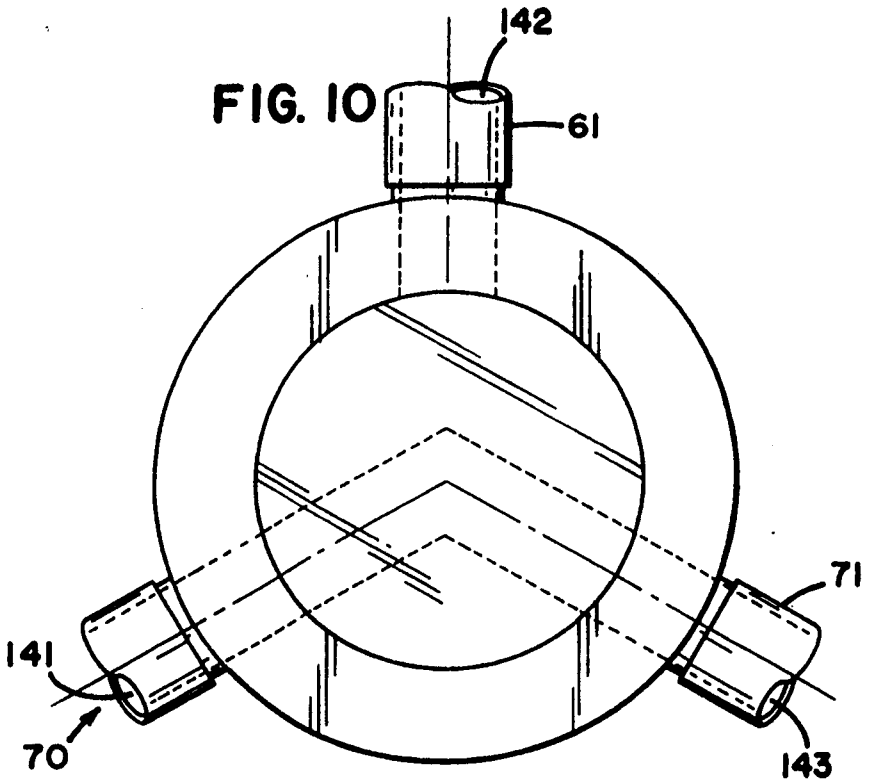
FIG. 10 is a schematic of the multi-position valve in the water delivery configuration.
Figure 9:
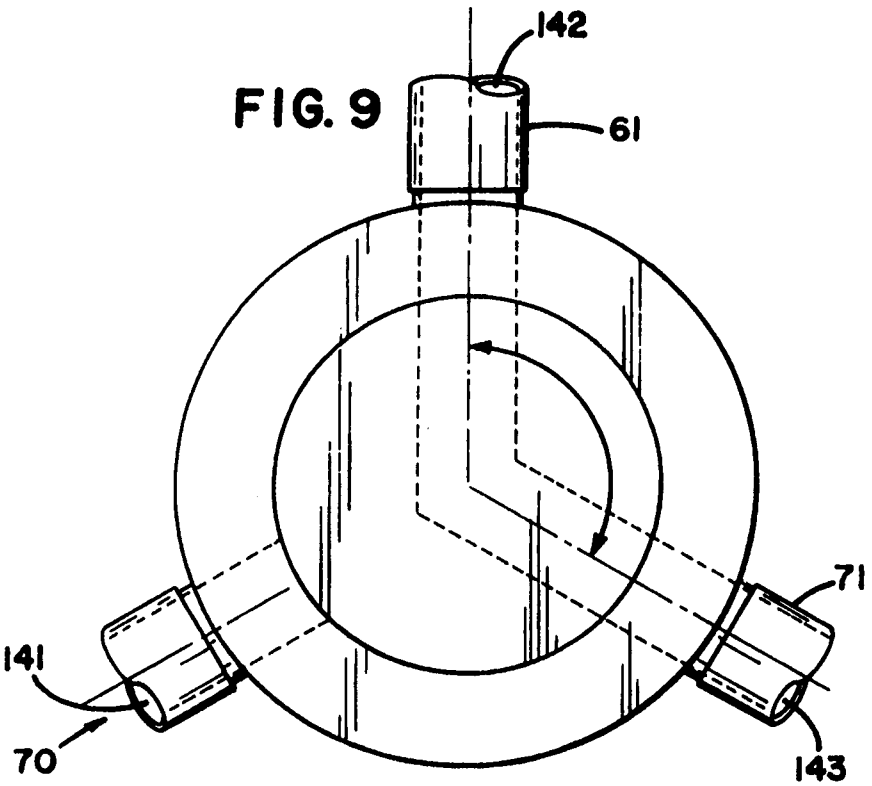
FIG. 9 is a schematic of the multi-position valve in the air delivery configuration.

A second embodiment is provided if the system is to be operated in a below freezing environment; a three way electro-mechanical multi-position valve, 140, see FIGS. 9 and 10, is provided. As an example the multi-position valve could be either a gate valve, a globe valve or a ball valve. The multi-position valve, 140 is located between all of the sprinkler heads and the water supply, 70, as shown in FIG. 1. The multi-position valve, 140, as shown in FIG. 9, has a water input, 141, designed for input from the water supply, 70, an air input, 142, designed for input from a source of compressed air, 60, and has a water output, 143, connected to the water supply conduit, 71. The multi-position valve can be actuated by the timer/controller, 50, through another cable, 52, to be in one of three positions. In the first position the water input, 141, is in fluid communication with the water output, 143. In the second position the air input, 142, is in fluid communication with the water output, 143. In the third position the multi-position valve, 140, is closed. Thus when the multi-position valve, 140 is in its first position, water from the water supply, 70, will flow into the water input, 141, through the multi-position valve, 140, into the water output, 143, and finally into the water supply conduit, 71. When the multi-position valve, 140, is in its second position air will pass from an air conduit, 61, into the air input, 142, through the multi-position valve, 140, into the water output, 143, and will finally be blown or forced into the water supply conduit, 71.

A compressed air conduit, 61 is connected at one end to the multi-position valve, 140, at the air input, 142, and at its other end the compressed air conduit, 61, is connected to a source of compressed air, 60. In the preferred embodiment the source of compressed air is an oilless air compressor, although other sources of compressed air, for example bottled air would be sufficient. Generally an air compressor with a tank ranging in size from 40 to 80 gallons, and operating pressures of 30 to 60 psi would be acceptable. The air compressor conduit is generally made of tubing or pipe, and is ½ to 1 inch in diameter.

The timer/controller, 50, in the below freezing system is slightly different from the timer/controller used in the above freezing system. Because another valve is being controlled by the timer/controller, it must have more stations. For example where in the above freezing system a 6 station multi-function low voltage timer would be adequate, in the below freezing system one would need an nine station multi-function low voltage timer. An example of such a timer would be the Hardy model TC9I9 timer. The cable, 52, is generally of the same configuration as the cable, 51.

Figure 8:
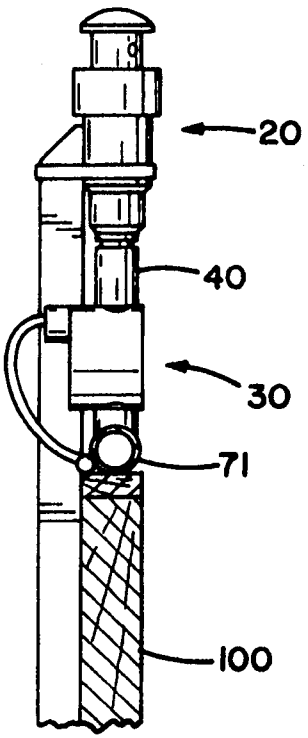
FIGS. 7 and 8 show partial sectional views taken generally along line 7—7, 8—8, in FIG. 1 showing alternative embodiments of the arrangement shown in FIG. 6.
Figure 7:
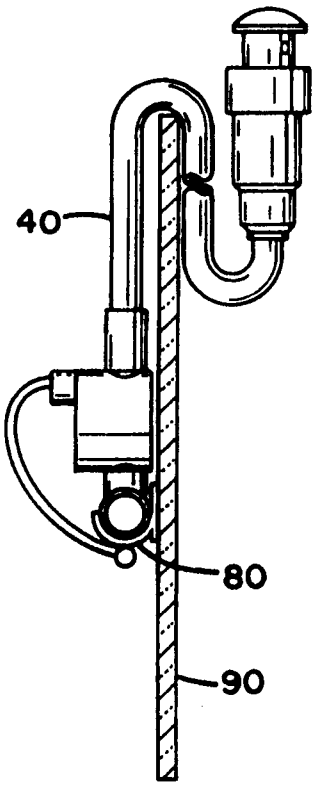

In FIGS. 7 and 8, there is shown alternative arrangements for the water supply conduit, 71, and the sprinkler conduit, 40. In FIG. 7, the water supply conduit, 71, is placed on the spectator side of the glass, 90. The water supply conduit, 71 is held in place by brackets, 80, and the sprinkler conduit, 40, is suspended from the top of the glass. In FIG. 8, the water supply conduit, 71, rests on the top of the boards, 100, and the sprinkler conduit, 40 may also be straight.

Figure 6:
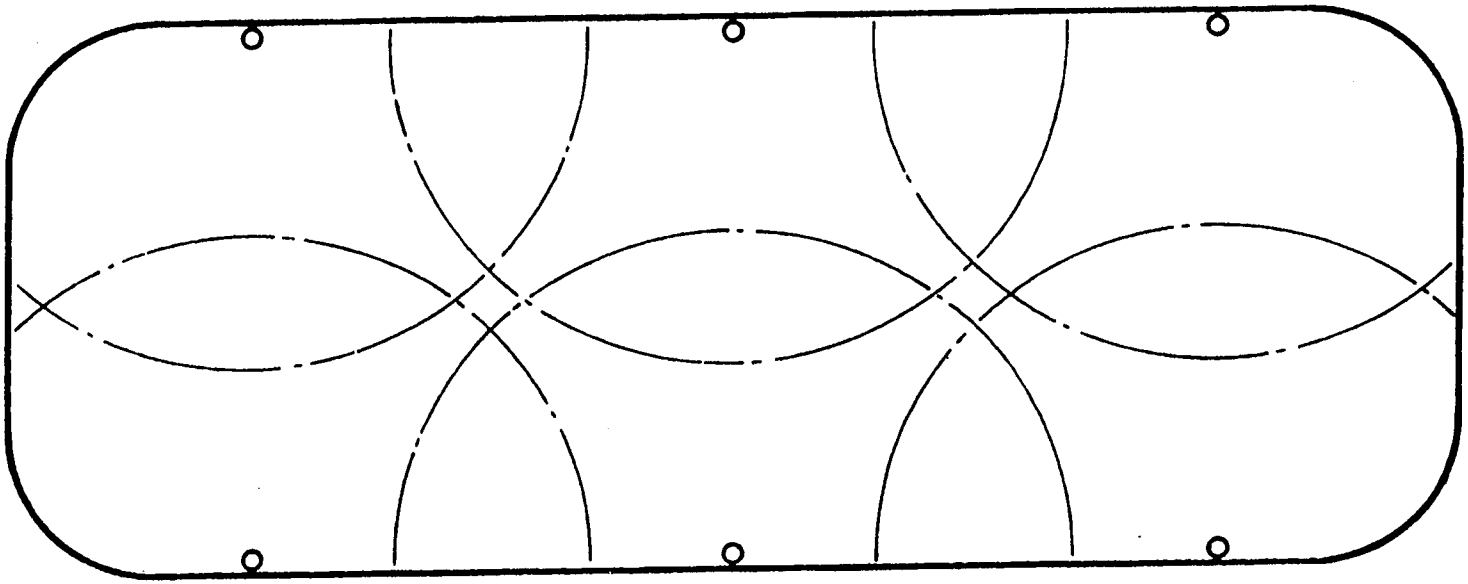
FIG. 6 is a schematic plan view of an ice rink showing an alternative spray design to that shown in FIG. 1.

Referring to FIG. 6, it can be seen that the sprinkler heads, 20, can be arranged in alternate fashions. FIG. 6, shows six sprinkler heads, three placed on each wide side of the ice rink. Other methods are also included in the present invention, such as placing the water supply conduit above the ice rink, and equally placing three sprinkler heads above the ice rink on the water supply conduit. Each sprinkler would spray in a complete circle, and smaller sprinklers could be used to fill in the gaps.

OPERATION

Figure 3:
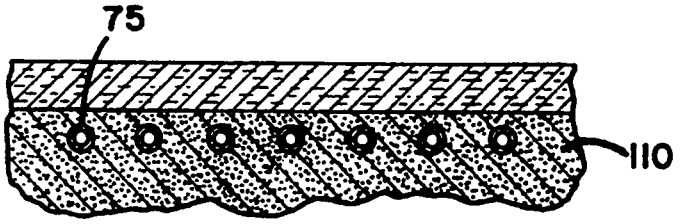
FIGS. 3 and 4 are partial sectional views of the floor of the rink, taken generally along line 3—3 in FIG. 1.
Figure 4:
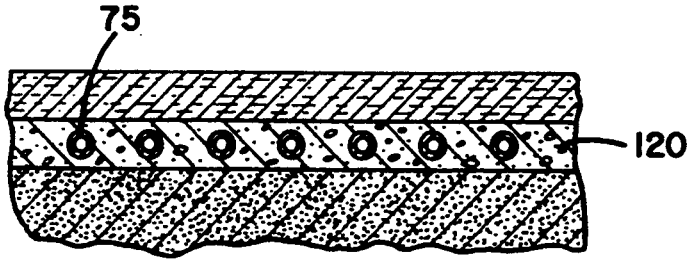
Figure 5:
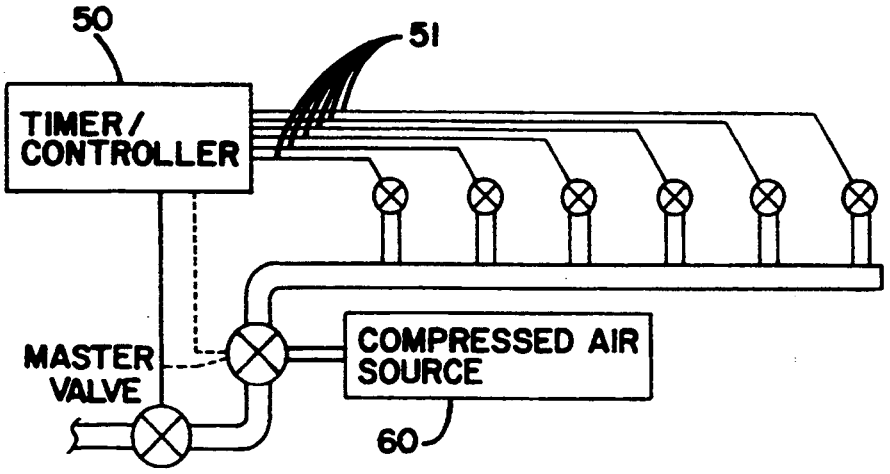
FIG. 5 is a schematic of the valve system, of the invention shown in FIG. 1.

In typical operation the chiller tube is turned to an "on" position. The chiller tubes are located beneath the surface of the rink as shown in FIGS. 3 and 4. This cools the surface of the rink to a temperature sufficient to freeze water. This temperature should be low enough to rapidly freeze the ice, and warm enough to prevent cracks from forming. Typically temperatures between about 10° and 20° F. work well, although this may change depending on altitude, or if there are any impurities in the water. It is believed temperatures around 15° F. typically work well. Water is allowed to flow into the water supply conduit from the water supply, which is generally accomplished by merely turning a water supply valve, 74, to its open position, or the timer/controller can actuate the water supply valve. Once water is flowing through the water supply conduit, 71, the timer/controller signals a single sprinkler valve to move to its open position. While the sprinkler valve is in its open position, the sprinkler head sprinkles water onto the ice. The timer/controller then signals the open sprinkler valve to its closed position, and signals another sprinkler valve to its open position.

For example, if sprinkler valve, 31, is opened first, sprinkler head, 21, sprinkles water in a semi-circular pattern for approximately 3 to 30 minutes. The sprinkling of water by sprinkler head, 21 defines a sprinkling zone, defined by the line 201 on FIG. 1. At the end of this time period the timer/controller, 50, closes sprinkler valve, 31, and opens sprinkler valve, 34, allowing sprinkler 24, to sprinkle, thus defining another sprinkling zone defined by line 204. This process cycles among all six sprinkler heads as sprinkler valves are closed and later reopened until, a sufficiently thick amount of ice is formed. In practice, it has been found that in the preferred spray design of FIG. 1, the following sequence of sprinkler operation is optimal: sprinkler valve 31 followed by 34, 36, 32, 33, and 35. The process generally takes approximately 14 hours.

If the system is to be used in a below freezing environment the operation is slightly more complicated. The timer/controller signals the multi-position valve, 140, through a cable, 52, to move to the first position, which allows the water to flow from the water supply, 70, into the water supply conduit, 71. Generally once the water is in the water supply conduit, 71, the timer/-controller, 50, signals a single sprinkler valve, 30, through a cable, 51, to move to an open position.

For example, sprinkler valve, 31 could be the first opened, so sprinkler head, 21, would sprinkle water in a semi-circular pattern for approximately 3 to 30 minutes. At the end of this time period the timer/controller, 50, actuates the multi-position valve, 140, into its second position, thus allowing compressed air to be blown into the water supply conduit, 71. The affect of this is to blow air through the only open sprinkler valve, 31, and out the sprinkler head, 21, which serves to remove excess water from the sprinkler valve 31, from the sprinkler conduit, 41, and from the sprinkler, 21. The compressed air is blown through the system for generally between, 10 and 45 seconds, which is sufficient to remove any excess water. This is especially important in areas where the temperature surrounding the ice rink surface may be well below 32° Fahrenheit, because if the water is not removed it may freeze in the sprinkler valve, 30, or the sprinkler head, 20, rendering that sprinkler inoperative or damaging the system.

After the water has been blown out through the open sprinkler valve, 21, the timer/controller, 50, actuates the sprinkler valve, 31, to its closed position. Once the sprinkler valve 31, is in a closed position the timer/controller signals the multi-position valve, 140, to move into its first position, allowing water to flow back into the water supply conduit, 71. With water once again in the water supply conduit, 71, the timer/controller, 50, actuates sprinkler valve 34 to an open position, and sprinkler head, 24, sprinkles water in a semi-circular pattern, thus defining a second sprinkling zone outlined by line 204, for the same time that the previous sprinkler did. After this time has passed the timer/controller, 50, signals the multi-position valve, 140, to move into its second position so that the excess water can be blown out of sprinkler valve 34, sprinkler head 24, and sprinkler conduit, 44 and sprinkler valve, 34 is closed. The timer/controller applies this sequence of commands to each sprinkler valve sequentially, 31 through 35, reopening sprinkler valve to 31 after sprinkler valve 36 is closed, until a sufficient amount of ice has formed on the rink surface.

For both above freezing and below freezing operation each sprinkler head, 20, needs to have its corresponding sprinkler valve, 30, in the off position a sufficient amount of time so that ice forms in the sprinkling zone defined by the sprinkler head, 20, which is generally 3 to 150 minutes. This allows the ice to freeze quickly and thoroughly. During the period when any given sprinkler valve is closed, other sprinkler heads are sprinkling, this allows for continued operation of the system. When any individual sprinkler head is reactivated by the timer/controller, 50, it is spraying water on a sheet of ice. To form a sufficient amount of ice on the rink surface, generally between 8 and 14 hours is necessary, which is approximately 7 cycles of the system.

The above examples are not intended to limit the invention, but merely to serve as an illustration of how the invention might operate. Besides changing the position of the sprinklers, the sequencing of the sprinklers could easily be changed. Generally only one sprinkler head is used at a single time. It should be obvious that multiple sprinkler heads could be used at a single time with sufficient water pressure. In light of the above teachings it will be appreciated that several variations of the disclosed embodiments are possible. Those skilled in the art will no doubt be able to utilize the teachings of this invention other than as specifically described above. Certainly substitution of other materials and variations in positioning the sprinkler heads, or of the water supply conduit could be made. Therefore it is to be understood that the following invention is to be limited by the following claims.

I claim:

1. An ice rink forming apparatus to be used with an ice rink, said ice rink having a rink surface and a means for cooling said rink surface to a temperature sufficient to freeze water, said ice forming apparatus comprising:

(a) the water supply conduit connected to a supply of water, and located adjacent to said rink surface;

(b) a plurality of sprinkle conduits in fluid communication with said water supply, and located along said water supply conduit at preselected locations;

(c) a plurality of sprinkler heads in fluid communication with said sprinkler conduits;

(d) a plurality of sprinkler valves, each of said sprinkler valves having an open position and a closed position, one of said sprinkler valves being located on each of said sprinkler conduits between said sprinkler head, and said water supply conduit;

(e) a timer electrically connected to each of said sprinkler valves, so that said timer is operable to move each of said valves from said open position to said closed position at predetermined intervals;

(f) an inner supply conduit connected to a source of compressed air; and, (g) a multi-position valve, having a water input, an air input, and a water output, said multi-position valve having a first position in which said water input is in fluid communication with said water output, and a second position in which said air input is in fluid communication with said water output, said water supply conduit being in fluid communication with said water output, said water supply being in fluid communication with said water input, and said air input being operably attached to said air supply conduit, whereby when said multi-position valve is in said first position water is forced into said water supply conduit, and said timer moves said sprinkler valves between said open position and closed position to sprinkle water onto said rink surface to form ice, and when said multi-position valve is in said second position compressed air is blown into said water supply conduit.

2. An ice forming apparatus as in claim 1 wherein said multi-position valve is of the electromechanical type and is operably attached to said timer so that said timer is operative and moving electromechanical multi-position valve from said first position to said second position.

3. A method of making ice on a rink surface comprising the steps of:

(a) providing a source of pressurized water, (b) delivering the pressurized water to plurality of fixed water dispensers, each of said water dispensers having an associated valve, each of said associated valves having an open position and a closed position, (c) controlling said associated valves between said open position and said closed position with a timing means, (d) sequentially dispensing the pressurized water to the rink surface through said water dispensers, (e) cooling the rink surface to form ice, (f) providing a source of compressed air, (g) blowing the water out of the water dispensers with the compressed air.

* * * * *